United States Patent [19]

Hunter

[11] Patent Number: 5,050,783

[45] Date of Patent: Sep. 24, 1991

[54] HOSIERY APPLIER

[76] Inventor: Ronald L. Hunter, 1190 W. Oregon Dr., Lakewood, Colo. 80232

[21] Appl. No.: 612,228

[22] Filed: Nov. 13, 1990

[51] Int. Cl.[5] ..... A47G 25/90

[52] U.S. Cl. ..... 223/112; 223/111

[58] Field of Search ..... 223/112, 111, 113, 116, 223/118, 119; 128/394

[56] References Cited

U.S. PATENT DOCUMENTS

| | | | |
|---|---|---|---|
| 2,894,669 | 7/1959 | Silken | 223/111 |
| 2,903,170 | 9/1959 | Ahn | 223/111 |
| 3,227,235 | 1/1966 | Minnema et al. | 223/111 |
| 3,604,604 | 9/1971 | Ahn | 223/111 |
| 3,692,217 | 9/1972 | Smith | 223/111 |
| 3,727,812 | 4/1973 | Weiss | 223/111 |
| 3,991,920 | 11/1976 | Hall | 223/111 |
| 4,482,084 | 11/1984 | Beskin | 223/111 |
| 4,966,316 | 10/1990 | George et al. | 223/113 |

*Primary Examiner*—Werner H. Schroeder
*Assistant Examiner*—Bibhu Mohanty

[57] ABSTRACT

A device is described which can be used by persons who for various reasons are on their own physically unable to apply onto their feet hosiery such as socks and stockings. This device is both inexpensive and not complex to manufacture and yet highly durable and simple to use. With this hosiery applier both hands are free to apply the hosiery onto the device. A stocking or sock can be pulled onto the foot of the user, a physically limited person, to a ready-to-wear position as readily as a nonlimited person can do it unaided. The device includes means on the outer tube member to support the device between the persons legs while placing the stocking on the device.

3 Claims, 1 Drawing Sheet

HOSIERY APPLIER

BACKGROUND OF THE INVENTION

1. Field of the Invention

The invention relates generally to a device for applying hosiery, such as socks and stockings, onto the legs of a wearer, and more particularly to a relatively inexpensive hand-held device which functions simply and efficiently to achieve a ready-to-wear position.

2. Description of the Related Art

Many persons cannot, without some degree of pain, bend their backs or legs to get in position to apply hosiery by themselves, and others are physically unable to do it at all without assistance from someone else, such as paid professional caretakers. There is therefore a need for a device which enables application of hosiery which is both inexpensive and yet durable, functional, and simple to use. The related art, including U.S. Pat. Nos. 2 894 669, 2 903 170, 3 604 604, 3 727 812, 3 883 052, 3 991 920, and 4 756 453, does not teach such a device that is hand operated that leaves both hands free to mount the hosiery to the device itself. Generally one hand is required to hold or steady the device while the other hand attempts to mount the hosiery onto it, a time consuming and often frustrating effort. In particular Silken 2 894 669 comprises three C-shaped holders interconnected by tubes, swivel joints and wires in a complicated combination of considerable expense and requiring a high degree of manual dexterity. Ahn 2 903 170 and 3 604 604 uses U-clamps in nesting relation, Weiss 3 727 812 uses pivoting opposing arms with extensions or spring fingers, Wilson 3 883 052 uses an adhesive contacting surface on a single rod. Hall 3 991 920 comprises two U-shaped clamping members with mating frictional surfaces including rubber or the like, offset from an upper mounting tube to accommodate a rolled stocking, a levered clamping mechanism to provide the wide range of pressure necessary to allow unrolling hosiery without slipping, and a telescoping lower holder rod. Pettit 4 756 453 uses two hinged telescoping posts with hosiery inverting loop-arms. Thus the relevant prior art is limited with respect to the cited needs and advantages in that each is either more expensive to fabricate or more complex or more difficult to use effectively than is desirable for the intended user; furthermore none of the above devices enable the user to mount the hosiery on the device with both hands since one hand is required simultaneously to hold and stabilize the device.

SUMMARY OF THE INVENTION

The present invention relates to a hosiery applier which overcomes the foregoing limitations of the related art. The device according to the invention includes two elongated supports comprised of strong material, preferably tubular stainless steel, resiliently coated with rubber or the like, a first one fastened as by welding to a hollow shaft near a handle end of the device and a second one fastened as by welding, approximately two-thirds down the length of the hollow shaft toward a clamping member end of the device, parallel to the first and each perpendicular to the longitudinal axis of the shaft, also preferably formed of tubular stainless steel. The device can thus be placed across the lap or tops of the legs of a seated user, and by simply laterally pressing the legs against the supports the user can firmly and stably hold the device. Thus both hands of the user are free to mount the hosiery, such as a stocking, onto the clamping member end of the device in preparation for applying to the foot. In the case of a handicapped person having the use of only one hand, the stocking can still be attached to the clamping member end of the device, which is being held firmly and stabilized by the legs of the user. The stocking is thereby engaged with just the front edge margin of the open end of the stocking over clamping member ends of a lower horseshoe-shaped member of round tubing stock, preferably stainless steel, which is covered with a resilient contacting layer such as rubber tubing. The back edge of the top margin of the stocking is then engaged over the apex of the lower horseshoe-shaped member at which point is fastened as by welding to the hollow shaft. Through the resilience of the stocking top margin, the stocking is in closely held retention around the rubber-coated steel horshoe tubing.

The user then grasps the device in one hand by a resilient knob, mounted at the opposing end of an inner tubular support member, such as a stainless steel tube, or possibly also rod, passing telescopingly and longitudinally through the hollow shaft, pressing the knob against the palm of the user's hand, whose fingers engage around the first perpendicular support near the handle end as well as a third perpendicular support fastened as by welding on the shaft in opposition to and along the axis of the first support. Upon the user pressing his fingers and palm together, compressing an expansion coil spring mounted between the inner support tube at its handle-knob end and the hollow support shaft near its handle end, forcing the lower end of the inner support tube toward the lower end of the support shaft. In such manner an upper horseshoe-shaped piece, preferably of stainless steel tubing, which is fastened as by welding to the inner support tube through the support shaft, holds the stocking tightly clamped between its resilient coating and that of the lower horseshoe-shaped member. To facilitate engagement of the horseshoe-shaped pieces a raceway slot is disposed longitudinally at the lower end of the support shaft, allowing the upper horseshoe-shaped piece to slide along and through the raceway slot as the inner support member telescopingly slides downwardly within the shaft.

The user next places the opening formed by the stocking mounted on the horseshoe-shaped pieces in front of his foot with the shaft of the device at his heel. Then with one swift motion of the foot relative to the device the stocking can be pulled onto the foot to a ready-to-wear position, at which point the user releases pressure on the handle allowing the handle spring to expand and return the upper horseshoe-shaped piece to its starting position. When the device is pulled again relative to the foot, the top margin of the stocking is released from the lower horseshoe-shaped member, allowing the elasticity of the stocking to provide a tight fit on the leg of the user. Removing the device from the leg through the open sides of the horseshoe-shaped pieces, the user then repeats the procedure on the other leg.

It is, therefore, an object of the present invention to provide a leg-stabilized device for applying hosiery wherein both hands of a physically limited user are free to mount the hosiery onto the device in preparation for applying to the foot.

It is another object of the present invention to provide for applying hosiery a hand-held device which is fabricated of relatively inexpensive materials in relatively simple configuration.

It is a further object of the present invention to provide for applying hosiery a hand-held device which functions simply and efficiently for the physically limited user to achieve a ready-to-wear position.

Other objects and advantages of the present invention will become evident when the following detailed description is read in conjunction with the accompanying drawings of a preferred embodiment of the invention.

DETAILED DESCRIPTION OF THE PREFERRED EMBODIMENT

Figure 1:
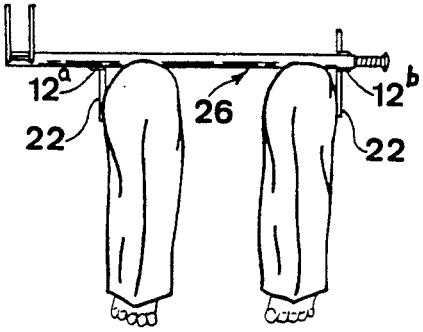
FIG. 1 is a perspective view of the hosiery applier held in position by the legs of the user.

FIG. 1 shows a hosiery applier 26 being held firmly by a user exerting pressure with his legs onto a stabilizing member comprising a pair of support elements, preferably tubular stainless steel, one element 12A disposed at a point approximately two-thirds the length of the applier from a handle end, and the other element 12B, which is disposed near said handle end, and which elements are fastened parallel to each other and perpendicular to the longitudinal axis of the applier 26 and covered with a resilient contact coating such as rubber tubing 22. Thereby the user is allowed the free use of both hands to mount an item of hosiery onto the applier 26. The item of hosiery, such as a stocking 11, is then stretched with just the front edge of its top margin over the paired ends of a lower horseshoe-shaped element 36A, which is covered with a resilient coating such as rubber tubing 16. The back edge of the top margin of the stocking 11 is then stretched by the user over the apex of said lower horseshoe-shaped element 36A. Through the elasticity in its top margin the stocking 11 is held closely around the lower horseshoe-shaped element 36A.

Figure 2:
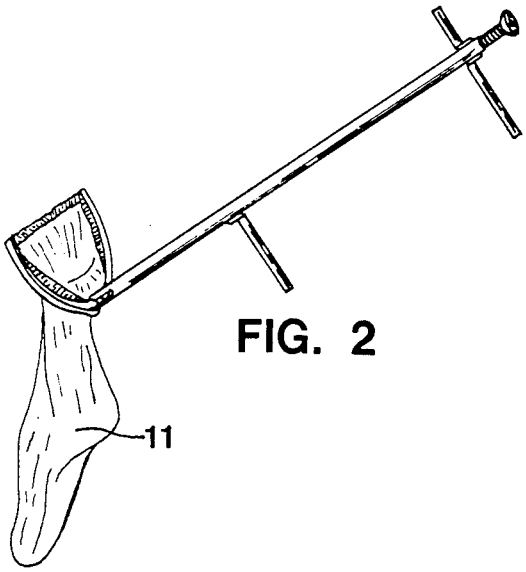
FIG. 2 is a perspective view of the hosiery applier with mounted hosiery ready to be applied.

The user then grasps the stocking applier 26 in one hand by a resilient knob 18, mounted at the opposing end of an inner telescoping member 32, preferably a stainless steel tube, passing longitudinally through an outer tubular member 34, preferably a stainless steel shaft 34, pressing the knob 18 against the palm of the user's hand, whose four fingers engage around the first perpendicular support element 12B near the handle end as well as a third perpendicular support, handle support element 10, also resiliently coated as by rubber tubing 20, fastened as by welding on the shaft 34 in opposition to and along the axis of the first support element 12B. The user then squeezes his hand compressing coil spring 8 mounted on tube 32 between shaft 34 and knob 18, forcing the lower end of tube 32 towards the lower end of of shaft 34. An upper horseshoe-shaped element 36B of the clamping member end, like its lower twin 36A covered with a resilient coating, is then compressed against its twin, tightly holding the stocking 11 as shown in FIG. 2.

The user then places the stocking opening in front of his foot, with shaft 34 positioned at his heel, and in one continuous motion pulls the stocking 11 to a ready-to-wear position. The user next releases compression on coil spring 8 allowing upper horseshoe-shaped element 36B to move back to its original resting position at the top of raceway slot 24. Pulling again on the device 26 displaces the top margin of the stocking 11 from the lower horseshoe-shaped element 36A. The device 26 is then simply removed from the side of the leg through the open end of the horseshoe-shaped elements 36A and 36B.

Figure 4:
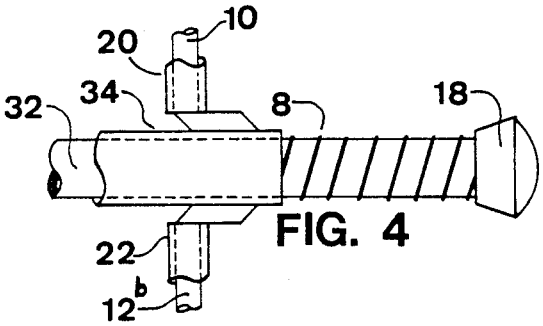
FIG. 4 is an enlarged fragmentary sectional view taken at 4—4 of FIG. 7.
Figure 5:
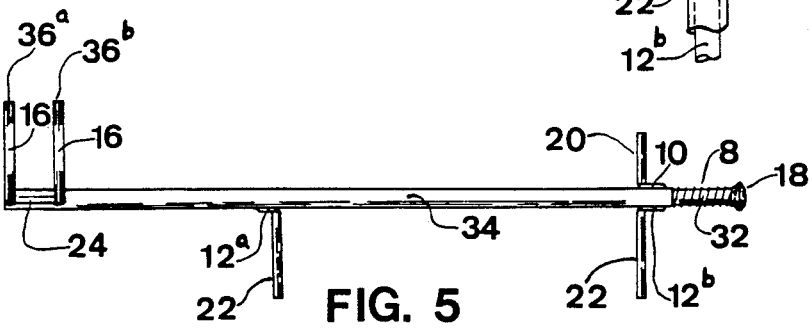
FIG. 5 is a side view of the hosiery applier device.

In FIG. 4 the hosiery applier 26 is shown with the inner telescoping steel tube 32 slidingly disposed within said outer tubular member 34. On the handle end of the device is shown coil spring 8 disposed around the protruding portion of the tube 32, on the end of which is mounted resilient knob 18 formed to fit into the palm of the user. Coil spring 8 disposed on tube 32 exerts a slight pressure against knob 18 and the top end of shaft 34. In such manner said coil spring 8 maintains the upper resiliently coated horseshoe-shaped element 36B, welded at its central or apex point in a plane perpendicular to the longitudinal axis of tube 32, in its resting position at the upper end of raceway 24 when no palm pressure is applied by the user, as shown in FIG. 5. Handle support 10 and support 12B may be implemented each simply butt-welded directly against shaft 34, or each bent at a right angle, each with a short arm welded onto and parallel to shaft 34, and each, or a long arm of each, in collinear configuration perpendicular to shaft 34 and coplanar with a midplane intersecting the apex points of the horseshoe-shaped elements 36A,36B and the axis of the second support 12A, thus orienting the common axis of supports 10, 12B perpendicular to the longitudinal direction of the raceway slot 24, as shown in FIG. 5. Said raceway slot 24 can be milled or stamped into the lower end of the shaft 34, opposite the upper or handle end. With such a configuration as implemented above, the user can wrap his fingers around handle components support 10 and support 12B with handle knob 18 placed in the palm of the same hand. The user can then squeeze the handle components together and compress spring 8 driving tube 32 towards the lower end of shaft 34.

Figure 3:
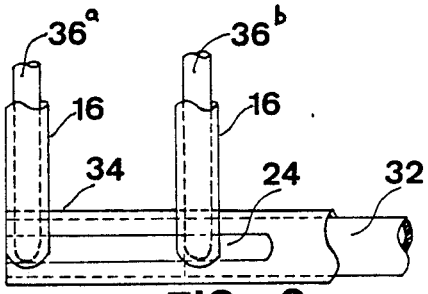
FIG. 3 is an enlarged fragmentary sectional view taken at 3—3 of FIG. 7.

FIG. 3 shows the lower portion of the device with horseshoe-shaped elements 36A and 36B as coated by resilient material 16, with element 36B welded to tube 32 and element 36A welded to shaft 34, each disposed in a plane perpendicular to the common longitudinal axis of telescoping tube and shaft. Horseshoe-shaped element 36B at its weld joint with inner telescoping support tube 32 is thus able to slide within the raceway slot 24 cut in shaft 34, enabling its congruent engagement with and along the full curvature of horseshoe-shaped element 36A as the parallel planes of the horseshoe-shaped elements, mutually perpendicular to the common axis of tube 32 and shaft 34, converge in close contact.

Figure 6:
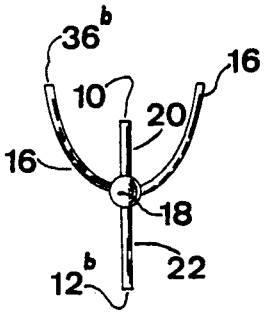
FIG. 6 is an end view from the handle end of the hosiery applier device.
Figure 7:
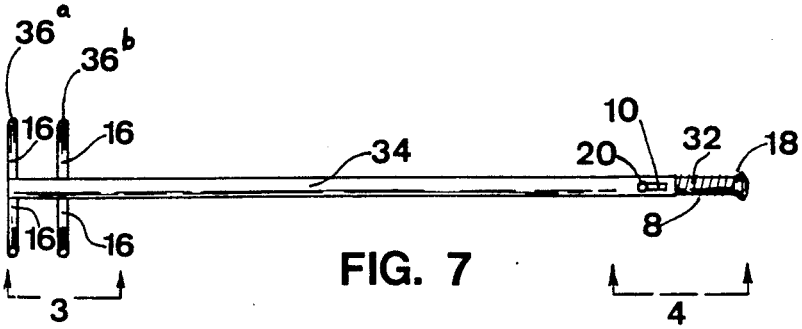
FIG. 7 is a top view of the hosiery applier device.

FIG. 6 shows a view from the handle end of the device in the direction of its longitudinal axis. The profile of the handle supports 10, 12B, 18 is shown in relation to horseshoe-shaped element 36B. FIG. 7 shows a top view of the device, at an orientation rotated 90 degrees from that of FIG. 6.

Although preferred embodiments of the invention have been described and illustrated above, it is to be understood that the invention is not limited to the embodiments disclosed, but is capable of numerous variations, rearrangements, modifications, equivalents and substitutions of parts and elements without departing from the spirit and scope of the invention as claimed.

I claim:

1. A hosiery applier device which can be stabilized by the legs of the user and operated with both hands comprising an outer tubular member with a handle end and a clamping member end, with a raceway slot disposed longitudinally at the clamping member end, an inner telescoping member sliding within said outer tubular member, and a clamping member with resilient coatings thereon comprising a lower horseshoe-shaped element fastened to said outer tubular member at said clamping end, and an upper horseshoe-shaped element fastened to said inner telescoping member through said raceway slot in said outer tubular member, and a stabilizing member comprising a pair of support elements, fastened to said outer tubular member, for stabilizing the device by contacting the legs of the user, and a handle member disposed at the handle end of said outer tubular member.

2. The hosiery applier device according to claim 1 in which said pair of support elements comprise structural supports, each having a resilient coating, one of said support elements fastened at the handle end and serving also as an element of said handle member, the other of said support elements fastened at approximately two-thirds the length of said outer tubular member from the handle end.

3. The hosiery applier device according to claim 2 in which said handle member comprises a coaxial spring-return handle having a resilient knob fastened at an end of said inner telescoping member, further including a compression spring disposed outside of and coaxially with said inner telescoping member between the end of said outer tubular member and said resilient knob, and finger-grasping means, fastened at the end of said outer tubular member, including one of said structural support elements mutually serving as an element of said stabilizing member and an opposing handle element, both elements resiliently coated.

* * * * *

UNITED STATES PATENT AND TRADEMARK OFFICE

CERTIFICATE OF CORRECTION

PATENT NO. : 5,050,783

DATED : Sep.24,1991

INVENTOR(S) : Ronald L. Hunter 11190 W. Oregon Dr.
Lakewood, Colo. 80232

It is certified that error appears in the above-identified patent and that said Letters Patent is hereby corrected as shown below: On the title page, item [75] Inventor:

The address of the inventor was mistakenly typed as 1190 W. Oregon Dr. The correct address is 11190 W. Oregon Dr.

Signed and Sealed this

Twenty-third Day of March, 1993

*Attest:*

STEPHEN G. KUNIN

*Attesting Officer*

*Acting Commissioner of Patents and Trademarks*